US010109472B2

(12) United States Patent
O'Brien et al.

(10) Patent No.: US 10,109,472 B2
(45) Date of Patent: Oct. 23, 2018

(54) TOOL FREE GAS CONE RETAINING DEVICE FOR MASS SPECTROMETER ION BLOCK ASSEMBLY

(71) Applicant: Micromass UK Limited, Wilmslow (GB)

(72) Inventors: Steve O'Brien, Manchester (GB); Ian Trivett, Cheadle (GB)

(73) Assignee: MICROMASS UK LIMITED, Wilmslow (GB)

( * ) Notice: Subject to any disclaimer, the term of this patent is extended or adjusted under 35 U.S.C. 154(b) by 97 days.

(21) Appl. No.: 15/022,994

(22) PCT Filed: Sep. 17, 2014

(86) PCT No.: PCT/GB2014/052820

§ 371 (c)(1),
(2) Date: Mar. 18, 2016

(87) PCT Pub. No.: WO2015/040387

PCT Pub. Date: Mar. 26, 2015

(65) Prior Publication Data

US 2016/0293395 A1 Oct. 6, 2016

(30) Foreign Application Priority Data

Sep. 20, 2013 (EP) ..... 13185313
Sep. 20, 2013 (GB) ..... 1316697.0

(51) Int. Cl.
*H01J 49/04* (2006.01)
*H01J 49/24* (2006.01)
(Continued)

(52) U.S. Cl.
CPC ..... *H01J 49/24* (2013.01); *H01J 49/04* (2013.01); *H01J 49/165* (2013.01); *H01J 49/26* (2013.01)

(58) Field of Classification Search
CPC ..... H01J 49/067; H01J 49/0422; H01J 49/04; H01J 49/0495
See application file for complete search history.

(56) References Cited

U.S. PATENT DOCUMENTS 4,760,253 A * 7/1988 Hutton ..... H01J 49/067 250/281
4,963,735 A * 10/1990 Okamoto ..... H01J 49/10 250/281
(Continued)

*Primary Examiner* — Wyatt Stoffa
(74) *Attorney, Agent, or Firm* — Womble Bond Dickinson (US) LLP; Deborah M. Vernon; Heath T. Misley

(57) ABSTRACT

A mass spectrometer is disclosed comprising an atmospheric pressure interface comprising an ion block or sub-assembly having an internal passage. The atmospheric pressure interface further comprises either an inner sampling cone, a capillary interface or other gas limiting interface. The mass spectrometer comprises a clamp formed from a thermally insulating material and a removable outer gas cone which is slidably inserted into or onto the clamp so that the outer gas cone is retained by the clamp in use. The clamp is arranged and adapted to be pushed by a user into engagement with the ion block or sub-assembly so as to position the outer gas cone adjacent the inner sampling cone, capillary interface or other gas limiting interface so as to secure the outer gas cone to the ion block or sub-assembly and to form a gas tight seal with the ion block or sub-assembly without use of mechanical fasteners.

15 Claims, 6 Drawing Sheets

(51) Int. Cl.
*H01J 49/16* (2006.01)
*H01J 49/26* (2006.01)

(56) References Cited

U.S. PATENT DOCUMENTS

| | | | | |
|---|---|---|---|---|
| 5,495,107 | A | 2/1996 | Hu et al. | |
| 5,793,039 | A * | 8/1998 | Oishi | H01J 49/067 250/288 |
| 6,448,565 | B1 * | 9/2002 | Erath | H01J 37/34 250/288 |
| 6,462,336 | B1 | 10/2002 | Bajic | |
| 6,759,650 | B2 | 7/2004 | Covey et al. | |
| 8,294,091 | B2 | 10/2012 | Jarrell | |
| 2003/0189170 | A1 * | 10/2003 | Covey | H01J 49/049 250/288 |
| 2009/0242747 | A1 * | 10/2009 | Guckenberger | H01J 49/04 250/281 |
| 2010/0096542 | A1 * | 4/2010 | Whitehouse | H01J 49/0431 250/282 |
| 2011/0085852 | A1 * | 4/2011 | Ferrara | F16B 7/20 403/350 |
| 2011/0089333 | A1 * | 4/2011 | Ferrara | H01J 27/022 250/396 R |
| 2011/0290994 | A1 * | 12/2011 | Jarrell | H01J 49/0422 250/282 |
| 2011/0303024 | A1 * | 12/2011 | Wallis | G01N 1/2247 73/863.21 |
| 2014/0157913 | A1 * | 6/2014 | Wallis | G01N 1/2247 73/863.01 |
| 2014/0326871 | A1 * | 11/2014 | Whitehouse | H01J 49/0431 250/288 |
| 2015/0008313 | A1 * | 1/2015 | Loboda | H01J 49/164 250/282 |

* cited by examiner

TOOL FREE GAS CONE RETAINING DEVICE FOR MASS SPECTROMETER ION BLOCK ASSEMBLY

CROSS REFERENCE TO RELATED APPLICATIONS

This application is the National Stage of International Application No. PCT/GB2014/052820, filed 17 Sep. 2014 which claims priority from and the benefit of United Kingdom patent application No. 1316697.0 filed on 20 Sep. 2013 and European patent application No. 13185313.7 filed on 20 Sep. 2013. The entire contents of these applications are incorporated herein by reference.

BACKGROUND TO OF THE PRESENT INVENTION

The present invention relates to an atmospheric pressure interface of a mass spectrometer, a mass spectrometer and a method of forming an atmospheric pressure interface of a mass spectrometer.

Mass spectrometers are known which comprise an atmospheric pressure interface. The atmospheric pressure interface comprises a removable outer gas cone and an inner sampling cone. The inner sampling cone is inserted within an ion block or sub-assembly which comprises a housing and which provides an interface between an ion source and the main housing of the mass spectrometer. The main housing of the mass spectrometer comprises several vacuum chambers and a mass analyser which is located in a downstream vacuum chamber. The outer gas cone is secured to the ion block or sub-assembly of the mass spectrometer using screws or allen bolts. The process of securing the outer gas cone to the ion block or sub-assembly of the mass spectrometer also secures the inner sampling cone in place.

Cone gas (e.g. nitrogen) is supplied to an annular region which is formed between the inner sampling cone and the outer gas cone. The cone gas flows out of the annular region to atmosphere through an aperture at the apex of the gas cone. Analyte ions generated by an ion source pass through the same aperture into the body of the ion block or sub-assembly i.e. in the opposite direction.

The cone gas helps to reduce the formation of undesired solvent cluster ions and solvent adduct ions and helps to keep the inner sampling cone (which includes a small gas limiting orifice) clean.

U.S. Pat. No. 5,793,039 (Oishi) discloses a conventional arrangement in which an outer cone is attached to a vacuum chamber by screws. An inner cone is detachably attached to a conical base by a clamp and screws.

GB 2288273 (Hu) discloses with reference to FIG. 3 a conventional arrangement in which an outer cone is secured to a mass spectrometer by screws.

US 2003/0189170 (Covey) discloses a mass spectrometer in which various elements are mounted and secured to the housing in a known manner.

WO 2009/137463 (Waters) discloses an ion source housing affixed on or about an opening of a high pressure region.

The conventional approach of securing an outer gas cone to an ion block or sub-assembly using screws or allen bolts suffers from the problem that in order to clean or replace the outer gas cone (or to access, clean or replace the inner sampling cone or other components) it is necessary for a user to use a tool such as a screwdriver or an allen key in order to unscrew the screws or allen bolts in order to detach the gas cone from the ion block.

The process of unscrewing and removing a conventional gas cone is problematic in that immediately after use the gas cone will be very hot and hence may be difficult for a user to handle. A user is exposed to the risk of suffering a burn from inadvertently touching the gas cone whilst unscrewing the gas cone from the ion block. Furthermore, once the gas cone has been unscrewed then there is an added risk that a user may accidentally drop the gas cone since it can be difficult to handle the gas cone particularly when it is very hot.

The use of screws or allen bolts to secure the gas cone to the ion block or sub-assembly of a mass spectrometer suffers from the problem that the screws or allen bolts will tend to seize up and will otherwise fail after a relatively short period of use since the screws or allen bolts are routinely subjected to harsh operating conditions. In particular, the screws or allen bolts are subjected to demanding temperature cycles and fluctuations as well as being exposed to harsh chemical fluids and heated gases. The harsh operating conditions reduces the effective lifetime of the screws or allen bolts.

Another problem with the conventional arrangement is that a user may inadvertently overtighten the screws or allen bolts which can damage the threads. Alternatively, a user may insufficiently tighten the screws or allen bolts which can result in gas and vacuum leakage and general sub-optimal performance.

It will be appreciated, therefore, that there are a number of significant problems with the conventional arrangement wherein an outer gas cone is secured to an ion block or sub-assembly using screws or allen bolts.

It is desired to provide an improved mass spectrometer.

SUMMARY OF THE PRESENT INVENTION

According to an aspect of the present invention there is provided a mass spectrometer comprising:

an atmospheric pressure interface comprising an ion block or sub-assembly having an internal passage, wherein the atmospheric pressure interface further comprises either an inner sampling cone, a capillary interface or other gas limiting interface; and a clamp formed from a thermally insulating material and a removable outer gas cone which is slidably inserted into or onto the clamp so that the outer gas cone is retained by the clamp in use, wherein the clamp is arranged and adapted to be pushed by a user into engagement with the ion block or sub-assembly so as to position the outer gas cone adjacent the inner sampling cone, capillary interface or other gas limiting interface so as to secure the outer gas cone to the ion block or sub-assembly and to form a gas tight seal with the ion block or sub-assembly without use of mechanical fasteners.

The preferred embodiment relates to a mass spectrometer having an easily removable atmospheric pressure interface and in particular an improved outer gas cone assembly. As will be understood by those skilled in the art, it is often necessary to remove the outer gas cone of a mass spectrometer from an ion block or sub-assembly in order to clean or replace the outer gas cone and also to access the inner sampling cone (or capillary or other interface) which is mounted behind the outer gas cone.

The outer gas cone of the preferred embodiment is advantageously secured to the ion block or sub-assembly without requiring the use of mechanical fasteners such as screws or allen bolts. Advantageously a user does not need to find or use a screwdriver or allen key in order to remove the outer gas cone from the ion block or sub-assembly.

Since the outer gas cone is not secured to the ion block or sub-assembly using screws or allen bolts then advantageously the gas cone according to the preferred embodiment does not suffer from the problems which are inherent with conventional mass spectrometers such as the failure of the fasteners which are used conventionally to secure the outer gas cone to the ion block or sub-assembly.

It also follows that the gas cone arrangement according to the preferred embodiment does not suffer from the potential problem of a user overtightening the screws or allen bolts or applying insufficient tension to the screws or allen bolts.

Another advantage of the preferred arrangement is that the clamp is preferably arranged to provide a constant load or securing force in order to secure the outer gas cone (and the inner sampling cone) to the ion block or sub-assembly of the mass spectrometer in a gas tight manner.

Moreover, advantageously the clamp according to the preferred embodiment is formed from a thermally insulating material, and is arranged and adapted such that the outer gas cone is retained by the clamp in use and is positioned in place (adjacent the inner sampling cone, capillary interface or other gas limiting interface) and a gas tight seal is formed with the ion block or sub-assembly by a user pushing the clamp into engagement with the ion block or sub-assembly. This greatly facilitates the handling of the metallic gas cone which may be very hot immediately after use, and significantly reduces the risk of a user suffering from a burn by inadvertently touching the outer gas cone whilst seeking to remove the outer gas cone from the ion block or sub-assembly.

It will be appreciated therefore that the present invention provides an improved mass spectrometer.

U.S. Pat. No. 5,793,039 (Oishi) discloses an inner skimmer cone 12 as shown in FIG. 6 which is secured by a clamp 34 which is secured using screws 35. An outer sampling cone 10 is shown in FIG. 2. The outer sampling cone 10 is also secured by screws. U.S. Pat. No. 5,793,039 (Oishi) does not disclose a clamp formed from a thermally insulating material and a removable outer gas cone which is slidably inserted into or onto the clamp so that the outer gas cone is retained by the clamp in use. U.S. Pat. No. 5,793,039 (Oishi) also does not disclose providing a clamp which is arranged and adapted to be pushed by a user into engagement with the ion block or sub-assembly so as to position the outer gas cone adjacent the inner sampling cone, capillary interface or other gas limiting interface so as to secure the outer gas cone to the ion block or sub-assembly and to form a gas tight seal with the ion block or sub-assembly without use of mechanical fasteners.

In an embodiment, the thermally insulating material comprises a plastic.

In an embodiment, the gas cone comprises a groove and the clamp comprises a surface which engages with the groove, wherein the gas cone is retained by the clamp by sliding the surface relative to the groove.

In an embodiment, the clamp comprises a groove and the gas cone comprises a surface which engages with the groove, wherein the gas cone is retained by the clamp by sliding the surface relative to the groove.

In an embodiment, the clamp comprises one or more bumps, projections, depressions or other features which substantially prevent the gas cone from inadvertently detaching from the clamp.

In an embodiment, the gas cone comprises one or more bumps, projections, depressions or other features which substantially prevent the gas cone from inadvertently detaching from the clamp.

In an embodiment, the clamp comprises one or more first bumps, projections, depressions or other features and the gas cone comprises one or more second bumps, projections, depressions or other features, wherein the first bumps, projections, depressions or other features engage in use with the second bumps, projections, depressions or other features so as to substantially prevent the gas cone from inadvertently detaching from the clamp.

In an embodiment, the one or more bumps, projections, depressions or other features substantially prevent the gas cone from inadvertently detaching from the clamp whilst the gas cone is detached from the ion block or sub-assembly.

In an embodiment, the mass spectrometer further comprises a device arranged and adapted to maintain the internal passage of the ion block or sub-assembly at a sub-atmospheric pressure.

In an embodiment, the atmospheric pressure interface comprises an inner sampling cone, and wherein an annular region is formed between the inner sampling cone and the outer gas cone.

In an embodiment, the mass spectrometer further comprises a device arranged and adapted to supply a cone gas to the annular region.

In an embodiment, the cone gas comprises nitrogen, air, carbon dioxide or sulphur hexafluoride ("$SF_6$").

In an embodiment, the mass spectrometer further comprises an ion source.

In an embodiment, the ion source comprises an Electrospray ionisation ("ESI") ion source.

In an embodiment, ions emitted from the ion source are drawn along an ion path which passes through the outer gas cone and then through the inner sampling cone, capillary interface or other gas limiting interface into the internal passage of the ion block or sub-assembly.

In an embodiment, the mass spectrometer comprises a miniature mass spectrometer.

According to an aspect of the present invention there is provided a method of forming an atmospheric pressure interface of a mass spectrometer comprising:

providing a clamp formed from a thermally insulating material;

sliding a removable outer gas cone into or onto the clamp so that the outer gas cone is retained by the clamp; and pushing the clamp into engagement with an ion block or sub-assembly having an internal passage of a mass spectrometer so as to position the outer gas cone adjacent an inner sampling cone, capillary interface or other gas limiting interface of the mass spectrometer so as to secure the outer gas cone to the ion block or sub-assembly and to form a gas tight seal with the ion block or sub-assembly without use of mechanical fasteners.

According to an aspect of the present invention there is provided an atmospheric pressure interface for a mass spectrometer comprising:

a clamp; and a removable gas cone which is slidably inserted into or onto the clamp and which is retained by the clamp in use;

wherein the clamp is arranged and adapted to be pushed by a user into engagement with an ion block or sub-assembly of a mass spectrometer so as to secure the gas cone to the ion block or sub-assembly.

The clamp is preferably formed from a thermally insulating material. The thermally insulating material preferably comprises a plastic.

According to an embodiment the gas cone comprises a groove and the clamp comprises a surface which engages with the groove, wherein the gas cone is retained by the clamp by sliding the surface relative to the groove.

According to an embodiment the clamp comprises a groove and the gas cone comprises a surface which engages with the groove, wherein the gas cone is retained by the clamp by sliding the surface relative to the groove.

The clamp preferably comprises one or more bumps, projections, depressions or other features which substantially prevent the gas cone from inadvertently detaching from the clamp.

The gas cone preferably comprises one or more bumps, projections, depressions or other features which substantially prevent the gas cone from inadvertently detaching from the clamp.

According to the preferred embodiment the clamp comprises one or more first bumps, projections, depressions or other features and the gas cone comprises one or more second bumps, projections, depressions or other features, wherein the first bumps, projections, depressions or other features engage in use with the second bumps, projections, depressions or other features so as to substantially prevent the gas cone from inadvertently detaching from the clamp.

According to an aspect of the present invention there is provided a mass spectrometer comprising an atmospheric pressure interface as described above.

The mass spectrometer preferably comprises an ion block or sub-assembly having an internal passage.

The mass spectrometer preferably further comprises a device arranged and adapted to maintain the internal passage of the ion block or sub-assembly at a sub-atmospheric pressure.

The mass spectrometer preferably further comprises a removable sampling cone which is insertable into the ion block or sub-assembly.

The clamp is preferably arranged and adapted to secure the gas cone to the ion block or sub-assembly so that the gas cone forms a gas tight seal with the ion block or sub-assembly.

The clamp is preferably arranged and adapted to be pushed by a user into engagement with the ion block or sub-assembly so as to position the gas cone adjacent the sampling cone.

An annular region is preferably formed between the sampling cone and the gas cone.

The mass spectrometer preferably further comprises a device arranged and adapted to supply a cone gas to the annular region.

The cone gas preferably comprises nitrogen, air, carbon dioxide or sulphur hexafluoride ("$SF_6$").

The mass spectrometer may comprise a capillary interface or other gas limiting interface which is inserted in use within the ion block or sub-assembly.

The mass spectrometer preferably further comprises an ion source.

The ion source preferably comprises an Electrospray ionisation ("ESI") ion source.

According to the preferred embodiment ions emitted from the ion source are preferably drawn along an ion path which passes through the gas cone and then through a sampling cone or other gas limiting interface into the internal passage of the ion block or sub-assembly.

The mass spectrometer preferably comprises a miniature mass spectrometer.

According to another aspect of the present invention there is provided a method of forming an atmospheric pressure interface of a mass spectrometer comprising:

providing a clamp;

sliding a removable gas cone into or onto the clamp so that the gas cone is retained by the clamp; and pushing the clamp into engagement with an ion block or sub-assembly of a mass spectrometer so as to secure the gas cone to the ion block or sub-assembly.

According to the preferred embodiment of the present invention there is provided an easily removable atmospheric pressure interface for a mass spectrometer and in particular an improved gas cone assembly.

The removable atmospheric pressure interface preferably comprises a gas cone which is preferably arranged to be positioned adjacent an inner sampling cone. The inner sampling cone is preferably inserted into and retained within the body of an ion block or sub-assembly of the mass spectrometer.

Ions are preferably directed into a sub-atmospheric pressure region of a mass spectrometer (e.g. an internal passage of the ion block or sub-assembly) by passing through the outer gas cone and the inner sampling cone which has a gas limiting orifice before then passing into an internal passage within the body of the ion block or sub-assembly. The ion block or sub-assembly is preferably secured to an intermediate pumping block or alternatively direct to the main housing of the mass spectrometer using a plurality of fixings. One or more elastomeric seals may be located between the ion block or sub-assembly and the pumping block or main housing of the mass spectrometer such that the seal(s) are compressed when the ion block or sub-assembly is secured to the pumping block or main housing of the mass spectrometer. As a result, a gas tight and vacuum tight seal is preferably formed between the ion block or sub-assembly and the pumping block or main housing of the mass spectrometer.

The gas cone is advantageously secured to the ion block or sub-assembly without requiring the use of mechanical fasteners such as screws or allen bolts. Furthermore, advantageously a user does not need to find or use a screwdriver or allen key in order to remove the gas cone from the ion block or sub-assembly.

Since the gas cone is not secured to the ion block or sub-assembly using screws or allen bolts then advantageously the gas cone according to the preferred embodiment does not suffer from the problems which are inherent with conventional mass spectrometers such as the failure of the fasteners which are used conventionally to secure the gas cone to the ion block or sub-assembly.

It also follows that the gas cone arrangement according to the preferred embodiment does not suffer from the potential problem of a user overtightening the screws or allen bolts or applying insufficient tension to the screws or allen bolts.

Another advantage of the preferred arrangement is that the clamp is preferably arranged to provide a constant load or securing force in order to secure the gas cone (and the inner sampling cone) to the ion block or sub-assembly of the mass spectrometer in a gas tight manner.

The clamp preferably comprises a handle which is cool to touch and this greatly facilitates the handling of the metallic gas cone which may be very hot immediately after use. The preferred clamp also enables the clamp and metallic gas cone to be stood on a surface or bench without the metallic gas cone touching the surface or bench. As a result, the gas cone is advantageously not exposed to potential contamination since the gas cone does not come into contact with the surface or bench. The surface or bench is also not potentially damaged by coming into contact with the hot metallic gas cone. Furthermore, the preferred clamp and gas cone remains stable upon the surface or bench with the result that there is a negligible risk of the gas cone falling over and being damaged.

The clamp and gas cone arrangement according to the preferred embodiment significantly reduces the risk of a user suffering from a burn by inadvertently touching the gas cone whilst seeking to remove the gas cone from the ion block or sub-assembly.

The gas cone preferably comprises one or more bump features which are preferably arranged to interact with corresponding bump features which are provided on the clamp. As a result, the gas cone is preferably secured within the body of the clamp whilst the gas cone is being removed from the ion block or sub-assembly.

The one or more bump features are particularly advantageous in that they ensure that the gas cone is retained within the body of the clamp whilst the gas cone is detached from the ion block or sub-assembly. The clamp aids reinstallation of the gas cone and also enables a user to remove and transport the gas cone without any risk of accidentally dropping or otherwise damaging the gas cone.

The clamp preferably secures the gas cone to the body of the ion block or sub-assembly in a gas tight manner so that a cone gas (e.g. nitrogen) may be supplied to an annular region formed between the sampling cone and the gas cone. The cone gas then preferably exits via a central aperture in the gas cone.

The clamp advantageously ensures that electrical contact is preferably made between the metallic gas cone and the metallic ion block assembly or sub-assembly.

The clamp also preferably has an aerodynamic profile which advantageously significantly reduces undesirable turbulence effects in the ion source region.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (x) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The mass spectrometer may comprise a chromatography detector.

The chromatography detector may comprise a destructive chromatography detector preferably selected from the group consisting of: (i) a Flame Ionization Detector ("FID"); (ii) an aerosol-based detector or Nano Quantity Analyte Detector ("NQAD"); (iii) a Flame Photometric Detector ("FPD"); (iv) an Atomic-Emission Detector ("AED"); (v) a Nitrogen Phosphorus Detector ("NPD"); and (vi) an Evaporative Light Scattering Detector ("ELSD").

Additionally or alternatively, the chromatography detector may comprise a non-destructive chromatography detector preferably selected from the group consisting of: (i) a fixed or variable wavelength UV detector; (ii) a Thermal Conductivity Detector ("TCD"); (iii) a fluorescence detector; (iv) an Electron Capture Detector ("ECD"); (v) a conductivity monitor; (vi) a Photoionization Detector ("PID"); (vii) a Refractive Index Detector ("RID"); (viii) a radio flow detector; and (ix) a chiral detector.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

According to an embodiment analyte ions may be subjected to Electron Transfer Dissociation ("ETD") fragmentation in an Electron Transfer Dissociation fragmentation device. Analyte ions are preferably caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions preferably comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to a particularly preferred embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

An embodiment of the present invention will now be described with reference to FIG. 1.

Figure 1:
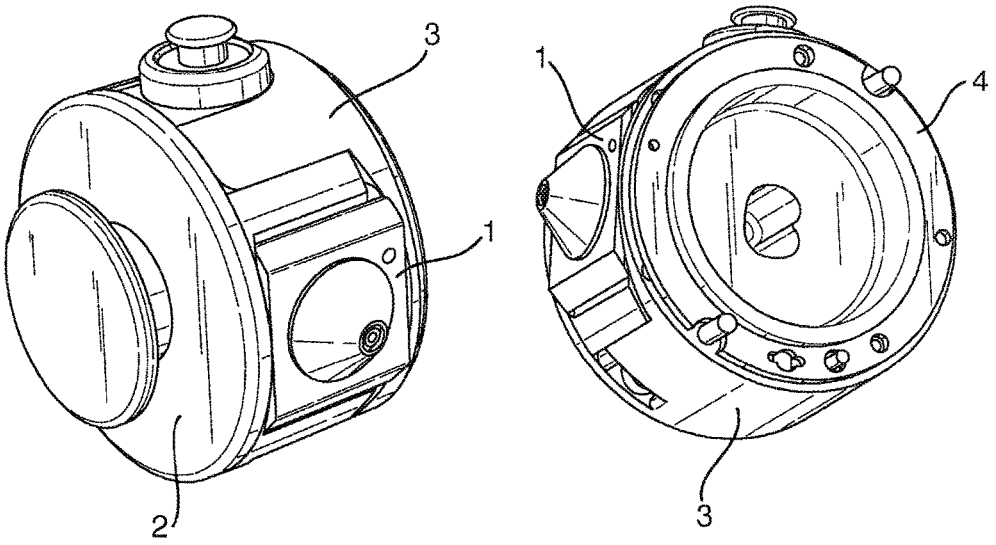
FIG. 1 shows a preferred embodiment of the present invention wherein a gas cone is secured by a clamp to an ion block or sub-assembly of a mass spectrometer.

FIG. 1 shows a gas cone 1 according to a preferred embodiment of the present invention. The gas cone 1 is shown secured by a clamp 2 to an ion block or sub-assembly 3 of a mass spectrometer. The ion block or sub-assembly 3 is preferably secured to an intermediate pumping block which is arranged between the ion block or sub-assembly 3 and the main housing of a mass spectrometer. Alternatively, the ion block or sub-assembly 3 may be secured direct to the main housing of the mass spectrometer (not shown). An elastomeric seal 4 is preferably provided between the ion block or sub-assembly 3 and the pumping block or main housing of the mass spectrometer. The ion block or sub-assembly 3 is preferably secured by allen bolts to the pumping block or main housing of the mass spectrometer which preferably causes the seal 4 to be under compression so as to provide a gas tight and vacuum tight seal between the ion block or sub-assembly 3 and the pumping block or main housing of the mass spectrometer. The gas cone 1 is preferably symmetric but as will be discussed in more detail below the gas cone 1 preferably includes one or more features which preferably ensure that a user is only able to insert the gas cone 1 into the clamp 2 in a correct orientation so that a port provided on the side of the gas cone 1 is correctly aligned with a corresponding gas port provided on the body of the ion block or sub-assembly 3. A cone gas is preferably supplied via the gas port on the body of the ion block or sub-assembly 3 and passed through the port provided on the side of the gas cone 1.

A sampling cone (not shown in FIG. 1) is inserted within the body of the ion block or sub-assembly 3. The gas cone 1 is preferably secured to the ion block or sub-assembly 3 by the clamp 2 and this clamping action also preferably secures the sampling cone in position.

As will be understood by those skilled in the art it is often necessary to remove a gas cone from an ion block or sub-assembly in order to clean or replace the gas cone and also to access the sampling cone (or capillary or other interface) which is mounted behind the gas cone. The sampling cone includes a small gas limiting orifice which is important to keep clean.

According to an embodiment of the present invention the gas cone 1 may be easily removed from the ion block or sub-assembly 3 in order to clean or replace the gas cone 1 and also to access, clean or replace the sampling cone and associated gas limiting orifice. Advantageously, the gas cone 1 can be removed from the ion block or sub-assembly 3 without needing to use a screwdriver or allen key.

The clamp 2 is preferably cool to touch and assists in preventing a user from inadvertently touching the potentially hot metallic surface of the ion block or sub-assembly 3 and the potentially hot metallic surface of the gas cone 1.

The clamp 2 may be used either by left or right handed users and requires relatively little force in order to secure the gas cone 1 to the ion block 3 and to remove the gas cone 1 from the ion block or sub-assembly 3.

A user preferably secures the clamp 2 to the ion block or sub-assembly 3 so that the gas cone 1 is preferably positioned concentrically with the sampling cone and associated gas limiting orifice.

The gas cone 1 is preferably mounted to the ion block 3 so that a cone gas can be fed or supplied direct to an annular region which is formed between the gas cone 1 and the sampling cone. The clamp 2 preferably secures the gas cone 1 and the sampling cone to the ion block or sub-assembly 3 with sufficient force or pressure so as to ensure that there is a gas seal at the interface between the ion block or sub-assembly 3, the sampling cone and the gas cone 1.

The gas cone 1 is advantageously secured to the ion block or sub-assembly 3 without requiring mechanical fasteners such as screws or allen bolts and without requiring the use of a screwdriver or an allen key.

Figure 2:
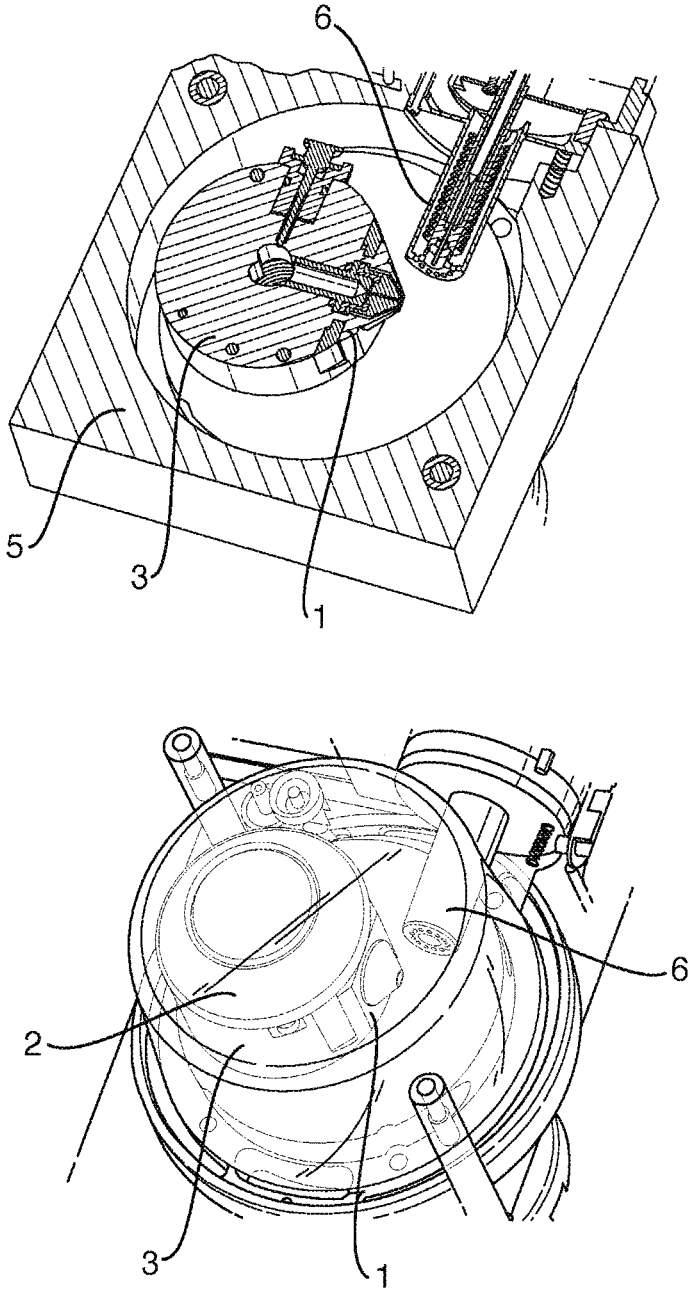
FIG. 2 shows a gas cone secured to an ion block by a clamp and arranged adjacent an ion source in an atmospheric pressure ion source chamber.

FIG. 2 shows the location of the ion block or sub-assembly 3, clamp 2 and attached gas cone 1 within an atmospheric pressure ion source chamber 5 according to an embodiment of the present invention. The ion source chamber 5 preferably comprises an atmospheric pressure chamber which forms an enclosed space and which preferably has no external gas leaks. The ion block or sub-assembly 3 and gas cone 1 are preferably located within an atmospheric pressure source enclosure 5. The ion block or sub-assembly 3 is one of the main mechanical assemblies that a user may need to access and service on a daily basis.

The ion block or sub-assembly 3 may reach temperatures of approximately 120° C. during use and the ion block or sub-assembly 3 may also be held at a voltage during use.

The gas cone 1 will become hot during use and the gas cone 1 also preferably holds a voltage during use. The gas cone 1 is preferably arranged to sit within the desolvation and nebulising gas flows which are emitted from an Electrospray ionisation ("ESI") ion source probe 6 and heater assembly.

The clamp 2 preferably has an aerodynamic profile that helps to prevent the clamp 2 from becoming contaminated with debris or other contaminants. The clamp 2 preferably has an optimal aerodynamic profile taking into consideration the effects of electrical fields in the ion source enclosure region 5 and the effects of gas flow dynamics due to the ion source.

Figure 3:
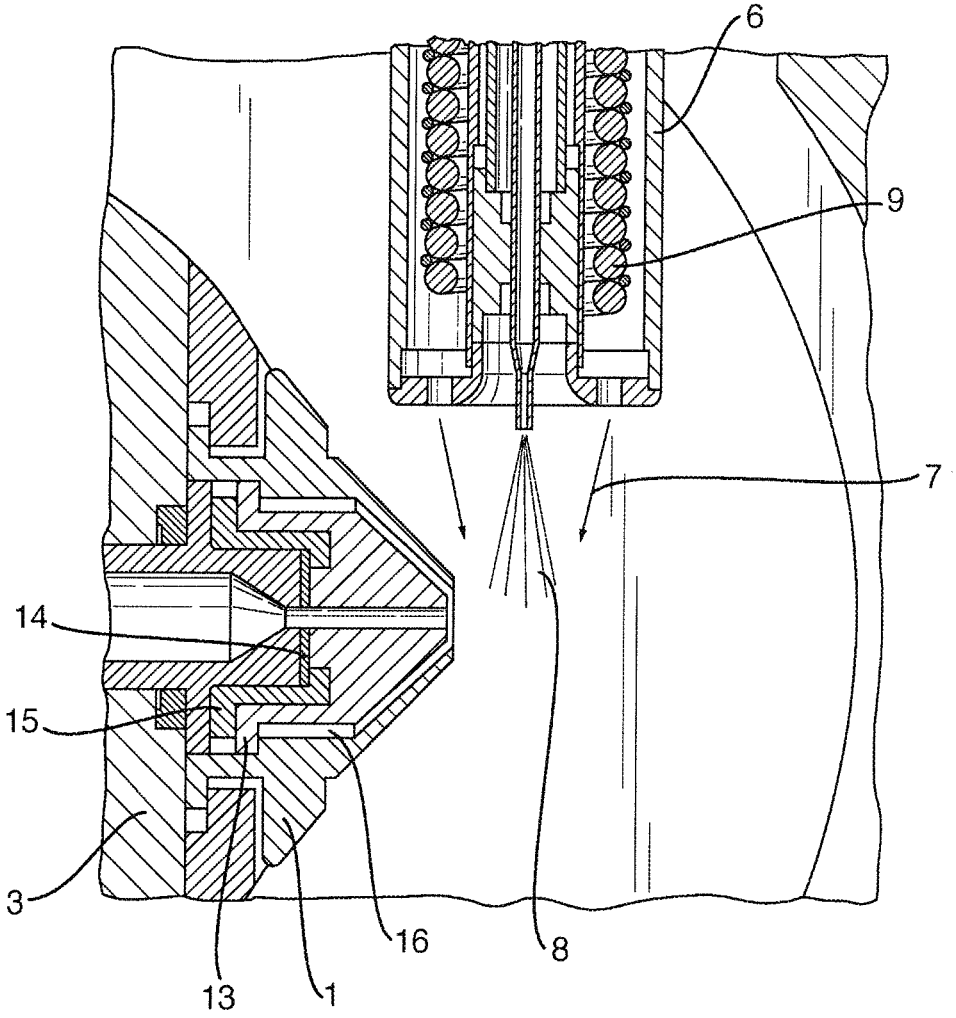
FIG. 3 shows a cross-sectional view of a preferred Electrospray ion source emitting a spray of liquid together with an annular flow of heated desolvation gas wherein analyte ions enter the mass spectrometer via the central aperture in the gas cone.

FIG. 3 shows in cross-section heated desolvation gas 7 and liquid flows 8 being emitted from a sample capillary 6. The heated desolvation gas 7 and liquid flow 8 are preferably directed towards the gas cone 1.

The gas cone 1 is preferably maintained at a voltage and preferably sits close to a heater 9 and the probe assembly 6. The clamp 2 secures the gas cone 1 to the ion block or sub-assembly 3 without requiring the use of mechanical fixings. This is particularly advantageous in that the use of mechanical fixings would add to gas flow turbulence effects which are generally undesirable. The atmospheric pressure interface according to the preferred embodiment preferably has a significantly enhanced aerodynamic profile which helps to improve the transmission of analyte ions into the ion block or sub-assembly 3.

The sampling cone 13 is shown in FIG. 3 and a tube is inserted into the rear of the sampling cone 13 which secures a disk 14 having a gas limiting orifice in position. The disk 14 is secured by a seal 15. An annular region 16 is preferably formed between the sampling cone 13 and the gas cone 1.

The gas cone 1 is preferably arranged to be secured by the clamp 2 against the ion block or sub-assembly 3 so that the sampling cone 13 and associated gas limiting orifice form a gas seal in the ion block or sub-assembly 3. Cone gas (e.g. nitrogen, air, carbon dioxide or sulphur hexafluoride ("$SF_6$")) is preferably provided to the annular region 16 between the outer gas cone 1 and the inner sampling cone 13. According to a preferred embodiment the cone gas may comprise nitrogen which is preferably pumped into the cavity 16 between the sampling cone 13 and the gas cone 1.

Final assembly of the clamp 2 against the ion block or sub-assembly 3 preferably ensures compression on other seals within the ion block assembly or sub-assembly 3 so as to maintain vacuum and gas seals as required.

In order to remove the orifice disk 14 and associated seal 15 within the sampling cone 13 it is first necessary to remove the gas cone 1.

Figure 4:
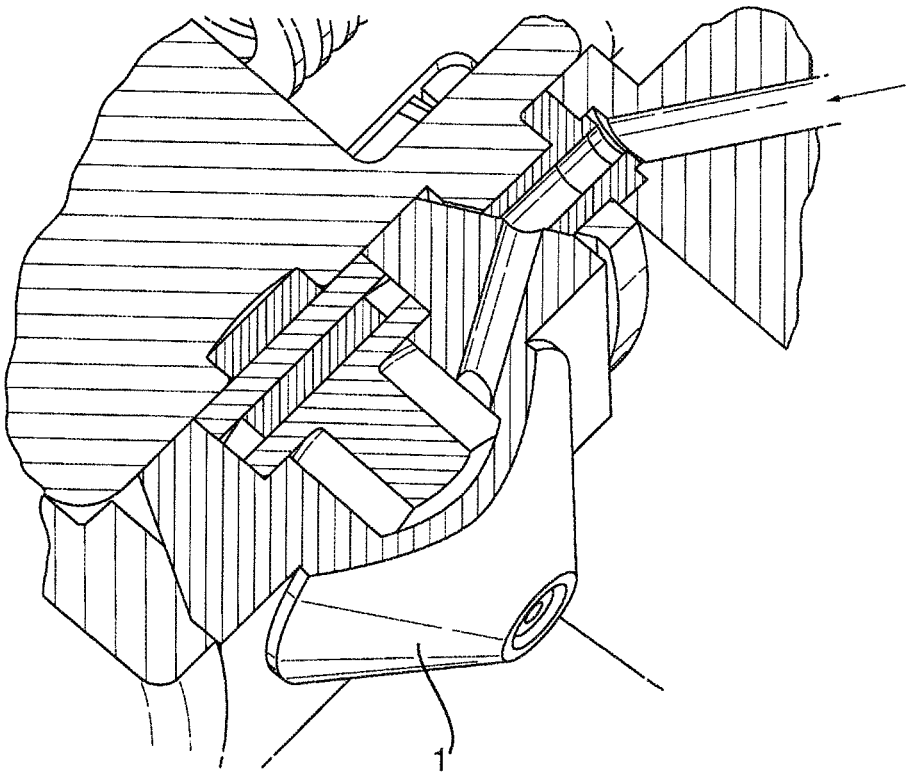
FIG. 4 illustrates how a cone gas may be supplied to an annular region formed between the inner sampling cone and the outer gas cone.

FIG. 4 illustrates how a cone gas may be directed through a port into the annular region 16 between the gas cone 1 and the sampling cone 13. The cone gas subsequently emerges from the inlet aperture to the gas cone 1 and may rejoin the main sample flow into the mass spectrometer. Any flow not flowing into this aperture preferably flows from the source via an exhaust.

Figure 5:
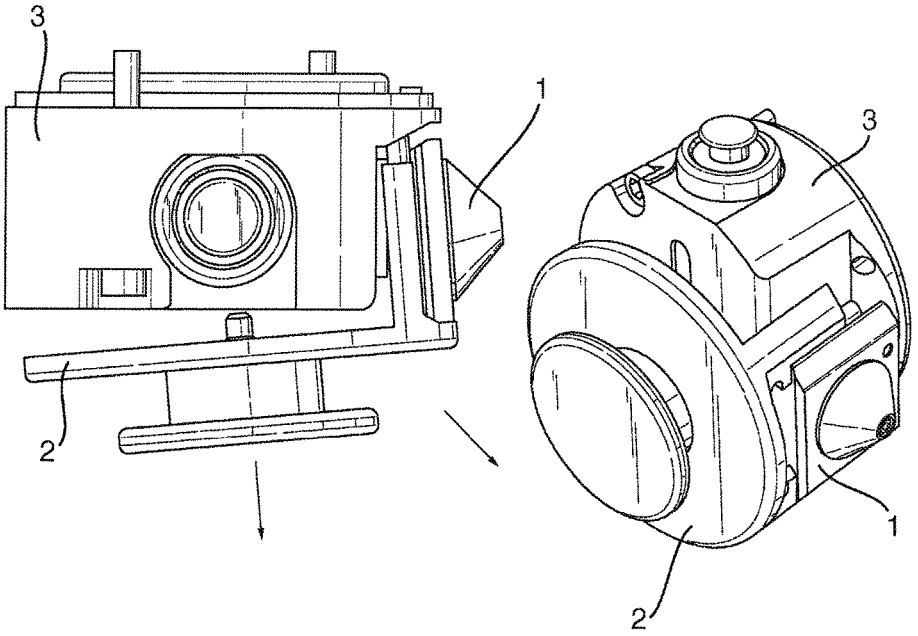
FIG. 5 illustrates the process of detaching the clamp and attached gas cone from the body of an ion block or sub-assembly.

FIG. 5 illustrates the process of removing the gas cone 1 from the ion block or sub-assembly 3 using the clamp 2. The clamp 2 is preferably pulled using a finger grip and is preferably released from a back groove of the ion block or sub-assembly 3. The clamp 2 is then preferably pulled in the direction of the longitudinal axis of the gas cone 1 in order to remove the gas cone 1 from the ion block or sub-assembly 3.

Figure 6:
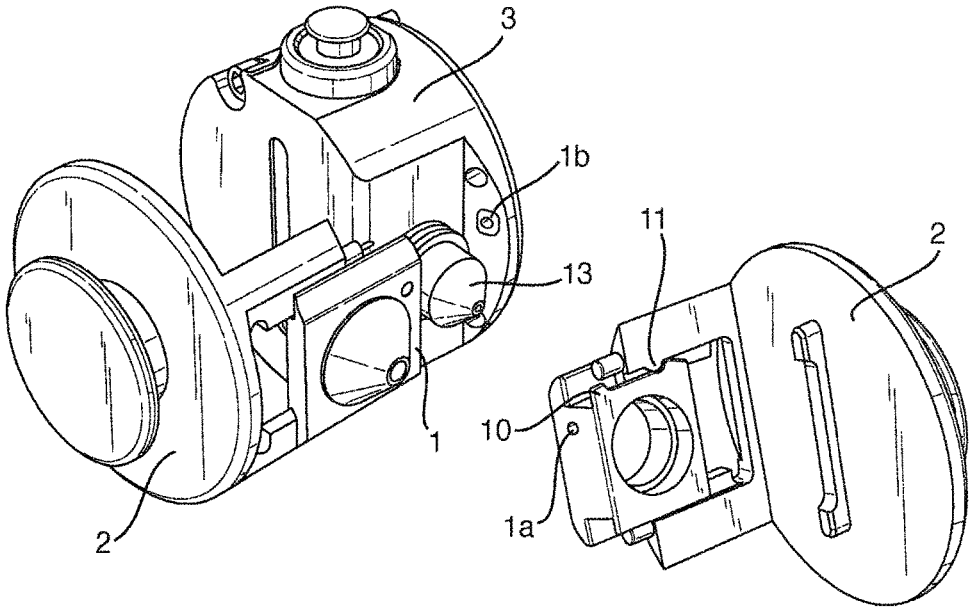
FIG. 6 shows a gas cone which is retained within the body of a clamp by bump features provided on both the gas cone and the clamp, wherein the bump features substantially prevent the gas cone from becoming inadvertently detached from the clamp when the clamp is removed from the ion block or sub-assembly.

FIG. 6 shows the gas cone 1 having been detached from the ion block or sub-assembly 3 but still remaining secured within the body of the clamp 2 by bump features 10,11 which are preferably provided on both the clamp 2 and the gas cone 1. The bump features 10,11 preferably ensure that the gas cone 1 remains secured to the clamp 2 after the gas cone 1 and clamp 2 have been detached from the ion block or sub-assembly 3. This advantageously protects against dropping the gas cone 1 and also helps to prevent a user from inadvertently touching the gas cone 1 which may be very hot. Furthermore, removal of just the gas cone 1 leaves the sampling cone 13 in position and does not immediately affect machine vacuum levels since the sampling cone 13 and associated gas limiting orifice do not also need to be removed. Although the sampling cone 13 is no longer mechanically clamped to the ion block or sub-assembly 3, the vacuum inside the ion block or sub-assembly 3 will, initially at least, still retain the sampling cone 13 within the body of the ion block or sub-assembly 3.

The bump features 10,11 are preferably also provided so as to ensure that a user can only slide or insert the gas cone 1 so that the gas cone 1 is retained within the body of the clamp 2 in one orientation. As a result, it is ensured that a cone gas port 1*a* provided in the side wall of the gas cone 1 is then always correctly aligned or otherwise orientated with a corresponding cone gas supply port 1*b* provided in a sidewall of the ion block or sub-assembly 3.

As is apparent from FIG. 6, the gas cone 1 is preferably retained within the body of the clamp 2 by small bump features 10,11 which allow some degree of relative sliding movement between the clamp 2 and the gas cone 1. The gas cone 1 may be fully removed from the clamp 2 when so desired by applying a sufficient degree of force so as to overcome the bump features 10,11.

Figure 7:
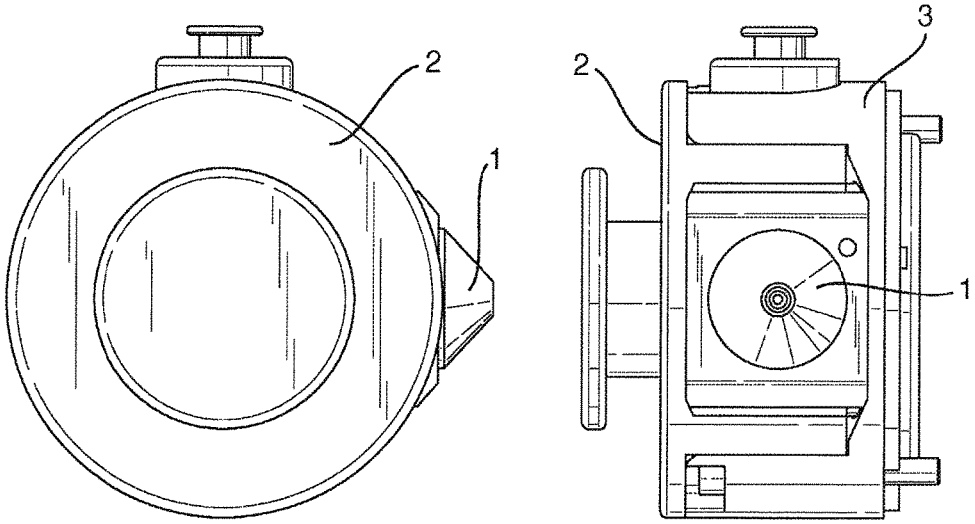
FIG. 7 shows an end view of a preferred clamp securing the gas cone to an ion block or sub-assembly and a side view which shows the gas cone being retained by the clamp and secured to the ion block or sub-assembly.

FIG. 7 shows an end view of the clamp 2 securing the gas cone 1 to an ion block or sub-assembly 3 and a side view showing the gas cone 1 being retained by the clamp 2 and secured against an ion block or sub-assembly 3.

The clamp 2 preferably has a geometry and a profile which is preferably complimentary to the geometry and profile of the ion block or sub-assembly 3. The clamp 2 preferably has the same outer profile as the ion block or sub-assembly 3 and preferably includes slide grooves with one or more bump features 11 in order to retain the gas cone 1 using the flex strain of the plastic clamp 2. The clamp 2 preferably has a substantially right angle profile which wraps around the ion block or sub-assembly 3 and which preferably positions the gas cone 1 in the correct position relative to the ion block or sub-assembly 3. The clamp 1 preferably has two or more locating pegs which are preferably arranged to be secured or otherwise received in two or more holes in the body of the ion block or sub-assembly 3. The clamp 2 is preferably pushed fully home to engage grooves on the front face of the ion block or sub-assembly 3. The act of locating these two features and using the spring tension of the clamp 2 preferably holds the clamp 2 in place against the ion block or sub-assembly 3. The clamp 2 may either be machined or injection moulded from a heat resistant material. The clamp 2 is preferably made or formed from a chemically stable material such as PEEK® or another material.

Although the present invention has been described with reference to preferred embodiments, it will be understood by those skilled in the art that various changes in form and detail may be made without departing from the scope of the invention as set forth in the accompanying claims.

The invention claimed is:

1. A mass spectrometer comprising:

an atmospheric pressure interface comprising an ion block or sub-assembly having an internal passage, wherein said atmospheric pressure interface further comprises either an inner sampling cone, a capillary interface or other gas limiting interface; and a clamp formed from a thermally insulating material and a removable outer gas cone which is slidably inserted into or onto said clamp so that said outer gas cone is retained by said clamp in use, wherein said clamp is arranged and adapted to be pushed by a user into engagement with said ion block or sub-assembly so as to position said outer gas cone adjacent said inner sampling cone, capillary interface or other gas limiting interface so as to secure said outer gas cone to said ion block or sub-assembly and to form a gas tight seal between the outer gas cone and said ion block or sub-assembly without use of screws or allen bolts.

2. A mass spectrometer as claimed in claim 1, wherein said thermally insulating material comprises a plastic.

3. A mass spectrometer as claimed in claim 1, wherein said gas cone comprises a groove and said clamp comprises a surface which engages with said groove, wherein said gas cone is retained by said clamp by sliding said surface relative to said groove.

4. A mass spectrometer as claimed in claim 1, wherein said clamp comprises a groove and said gas cone comprises a surface which engages with said groove, wherein said gas cone is retained by said clamp by sliding said surface relative to said groove.

5. A mass spectrometer as claimed in claim 1, wherein said clamp comprises one or more bumps, projections, depressions or other features which substantially prevent said gas cone from inadvertently detaching from said clamp.

6. A mass spectrometer as claimed in claim 1, wherein said gas cone comprises one or more bumps, projections, depressions or other features which substantially prevent said gas cone from inadvertently detaching from said clamp.

7. A mass spectrometer as claimed in claim 1, wherein said clamp comprises one or more first bumps, projections, depressions or other features and said gas cone comprises one or more second bumps, projections, depressions or other features, wherein said first bumps, projections, depressions or other features engage in use with said second bumps, projections, depressions or other features so as to substantially prevent said gas cone from inadvertently detaching from said clamp.

8. A mass spectrometer as claimed in claim 5, wherein said one or more bumps, projections, depressions or other features substantially prevent said gas cone from inadvertently detaching from said clamp whilst said gas cone is detached from said ion block or sub-assembly.

9. A mass spectrometer as claimed in claim 1, further comprising a device arranged and adapted to maintain said internal passage of said ion block or sub-assembly at a sub-atmospheric pressure.

10. A mass spectrometer as claimed in claim 1, wherein said atmospheric pressure interface comprises an inner sampling cone, and wherein an annular region is formed between said inner sampling cone and said outer gas cone.

11. A mass spectrometer as claimed in claim 10, further comprising a device arranged and adapted to supply a cone gas to said annular region.

12. A mass spectrometer as claimed in claim 1, further comprising an ion source.

13. A mass spectrometer as claimed in claim 12, wherein said ion source comprises an Electrospray ionisation ("ESI") ion source.

14. A mass spectrometer as claimed in claim 12, wherein ions emitted from said ion source are drawn along an ion path which passes through said outer gas cone and then through said inner sampling cone, capillary interface or other gas limiting interface into said internal passage of said ion block or sub-assembly.

15. A method of forming an atmospheric pressure interface of a mass spectrometer comprising:

providing a clamp formed from a thermally insulating material;

sliding a removable outer gas cone into or onto said clamp so that said outer gas cone is retained by said clamp; and pushing said clamp into engagement with an ion block or sub-assembly having an internal passage of a mass spectrometer so as to position said outer gas cone adjacent an inner sampling cone, capillary interface or other gas limiting interface of said mass spectrometer so as to secure said outer gas cone to said ion block or sub-assembly and to form a gas tight seal between the outer gas cone and said ion block or sub-assembly without use of screws or allen bolts.

* * * * *